United States Patent [19]

Edwards et al.

[11] Patent Number: 4,943,200

[45] Date of Patent: Jul. 24, 1990

[54] PORTABLE SELF-ERECTING ASPHALT STORAGE APPARATUS AND METHOD OF ERECTING SAME

[75] Inventors: M. Earl Edwards, Hixon, Tenn.; James G. May, Rising Fawn, Ga.

[73] Assignee: Astec Industries, Inc., Chattanooga, Tenn.

[21] Appl. No.: 296,492

[22] Filed: Jan. 12, 1989

[51] Int. Cl.[5] ..... B65G 69/00

[52] U.S. Cl. ..... 414/332; 414/21; 414/476; 414/483; 414/919; 414/786

[58] Field of Search ..... 414/332, 345, 389, 397, 414/919, 21, 476, 483, 786

[56] References Cited

U.S. PATENT DOCUMENTS

| | | | |
|---|---|---|---|
| 3,092,264 | 6/1963 | Milek | 414/332 X |
| 3,458,177 | 7/1969 | Farnham et al. | 414/919 X |
| 3,586,181 | 6/1971 | Brock | 414/332 |
| 3,934,739 | 1/1976 | Zumsteg et al. | 414/332 |
| 4,248,359 | 2/1981 | Brock | 414/919 X |
| 4,249,351 | 2/1981 | Brock | 414/332 X |
| 4,268,208 | 5/1981 | Hankins et al. | 414/332 |
| 4,337,014 | 6/1982 | Farnham | 414/332 |
| 4,348,146 | 9/1982 | Brock | 414/919 X |
| 4,465,420 | 8/1984 | Dillman | 414/332 |
| 4,482,281 | 11/1984 | Musil | 414/332 |
| 4,561,821 | 12/1985 | Dillman | 414/332 |
| 4,775,275 | 10/1988 | Perry | 414/919 X |

OTHER PUBLICATIONS

One page brochure entitled: ". . . There Really is a Line System", published by Astec Industries, Inc.

*Primary Examiner*—Frank E. Werner
*Assistant Examiner*—Keith L. Dixon
*Attorney, Agent, or Firm*—Bell, Seltzer, Park & Gibson

[57] ABSTRACT

A portable self-erecting storage apparatus for asphaltic mix is disclosed and which comprises an elongate material conveying assembly and a separate material storage assembly. The two assemblies are adapted to be separately transported on a highway to the construction site. To effect erection at the construction site, the two assemblies are joined in a nose-to-nose arrangement, and then lifted together in a smooth, continuous lifting operation by a pair of hydraulic jacks mounted on the storage assembly. In the erected position, the container of the storage assembly is vertically oriented and positioned at an elevated location above ground level so as to permit a truck to be driven below the container, and the conveying assembly is inclined upwardly so that its discharge end overlies the top of the container.

11 Claims, 3 Drawing Sheets

PORTABLE SELF-ERECTING ASPHALT STORAGE APPARATUS AND METHOD OF ERECTING SAME

FIELD OF THE INVENTION

The present invention relates to a portable self-erecting storage apparatus for temporarily storing and dispensing asphaltic mix and the like, and to the method of erecting the apparatus.

BACKGROUND OF THE INVENTION

When paving highways with asphaltic mix, it is desirable to locate the storage apparatus for the mix as near as possible to the construction site so that the trucks which carry the mix to the site do not have to travel long distances. To meet this objective, storage apparatus of various configurations have been proposed which are highway transportable, and which permit the apparatus to be moved to the construction site, erected, and used, and then dismantled and moved to a different construction site. Most designs of such portable apparatus require the use of a large crane to effect erection and dismantling, which substantially increases the cost of the operation. Other designs, such as those as set forth in Brock Pat. Nos. 3,586,181 and 4,348,146 do not require the use of cranes, but these designs have limited material capacity.

It is accordingly an object of the present invention to provide a large capacity, highway transportable asphaltic mix storage apparatus which is adapted to be erected and dismantled in remote areas without the use of cranes or other commercial lifting equipment.

It is a more particular object of the present invention to provide a storage apparatus which comprises a highway transportable material conveying assembly and a separately transportable material storage assembly, and wherein the conveying assembly and storage assembly may be interconnected at the construction site and erected simultaneously by a simple lifting process, and such that in the erected position the conveying assembly is able to convey the mix into the top of the erected storage assembly.

SUMMARY OF THE PRESENT INVENTION

These and other objects and advantages of the present invention are achieved in the embodiment illustrated herein by the provision of a portable self-erecting storage apparatus which comprises a material storage assembly having an elongate main frame, wheeled ground engaging carriage means mounted to the main frame for permitting highway transport of the material storage assembly, a secondary frame including a forward end portion and an opposite rear end portion, with the rear end portion being pivotally mounted to the main frame for pivotal movement about a horizontal pivotal axis, and a storage container mounted to the secondary frame and positioned between the forward and rear opposite end portions, and such that said secondary frame and said container may be pivoted about the pivotal axis between a generally horizontal position and a vertical upright position. Also, lifting means is mounted between the main frame and the secondary frame for pivoting the secondary frame and the container between the horizontal position and the upright position.

The apparatus of the invention also preferably includes a material conveying assembly comprising a supporting frame, an elongate material conveyor mounted to the frame and defining a material inlet end and a material outlet end, and wheeled ground engaging carriage means pivotally mounted to the frame adjacent the inlet end of the conveyor for permitting highway transport of the material conveying assembly and for permitting pivotal movement of the frame and the conveyor about a horizontal transverse pivotal axis, and such that the conveyor may be pivotally moved between a generally horizontal position and an upwardly inclined position wherein said outlet end is elevated. Interconnecting means are also provided for releasably and pivotally interconnecting the forward end portion of the secondary frame of the material storage assembly with the supporting frame of the material conveying assembly at a location adjacent said outlet end of the conveyor, and so as to permit relative pivotal movement about a horizontal third pivotal axis.

To effect the erection of the apparatus, the conveying assembly and the storage assembly are longitudinally aligned with the outlet end of the conveyor being opposed to the forward end portion of the secondary frame, and with the three pivotal axes being parallel to each other. The assemblies are then interconnected by the interconnecting means for relative pivotal movement about said third pivotal axis, and then collectively lifted by the lifting means to an operative position wherein the container is upright and the outlet end of the conveyor is elevated and disposed above the container.

The pivotal axis between the main frame and the secondary frame of the storage assembly preferably is elevated so as to lie substantially in horizontal alignment with the upper portions of the secondary frame and the container in the horizontal position thereof, and so that the container is elevated in the upright position a distance sufficient to receive a truck therebelow.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENT

Figure 1:
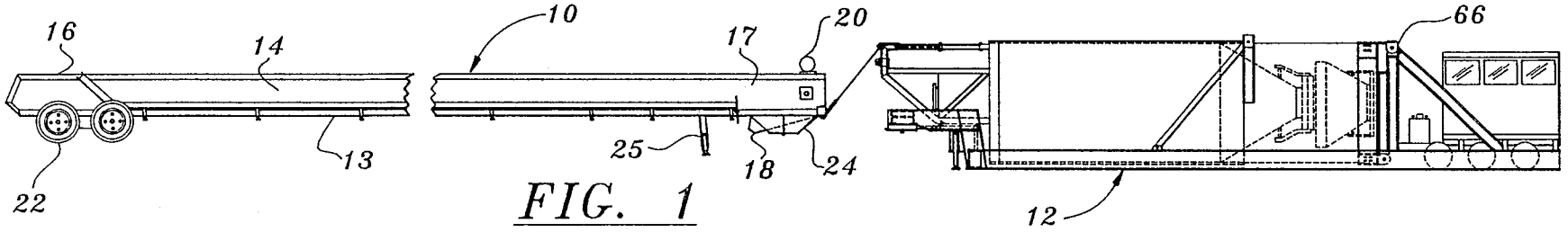
FIG. 1 is a side elevation view of a material conveying assembly and a material storage assembly which embody the present invention, and as positioned at the beginning of the erection process.
Figure 7:
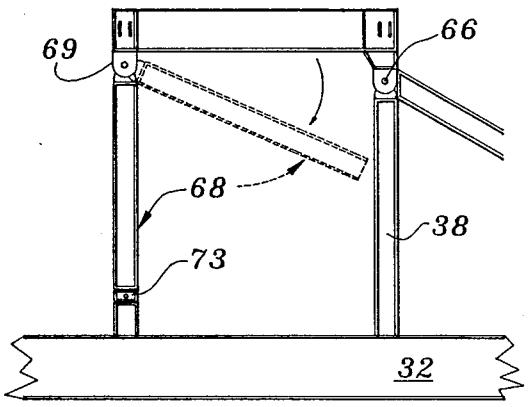
FIG. 7 is a fragmentary side elevation view of the lower portion of the material storage assembly and illustrating the pivotal support leg.

Referring more particularly to the drawings, a preferred embodiment of the present invention is illustrated and which comprises a material conveying assembly 10, and a material storage assembly 12. The material conveying assembly 10 includes an elongate supporting frame 13, and a housing 14 mounted on the frame and which encloses a material conveyor (not shown) of conventional design. The conveyor defines a material receiving inlet end 16 and a material outlet end 17, and which includes a discharge chute 18. The conveyor is powered by an electric motor 20 which is mounted on the housing adjacent the outlet end 17.

Figure 6:
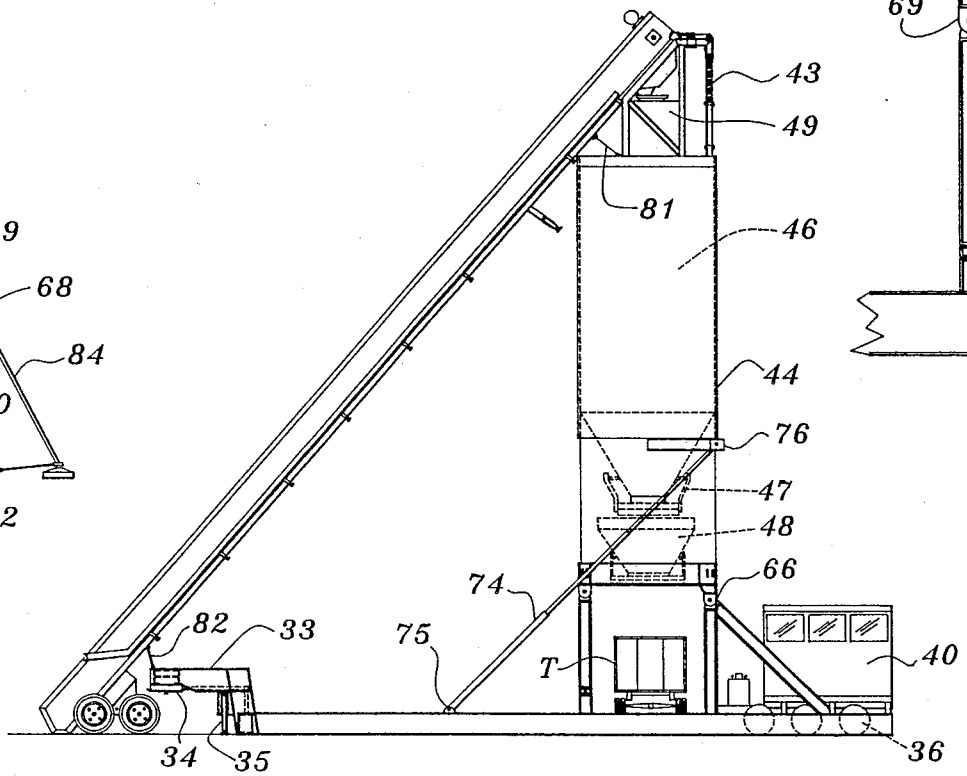
FIG. 6 is a side elevation view of the two assemblies in their final erected position.

The conveying assembly 10 also includes a wheeled ground engaging carriage 22 which is mounted to the frame 13 adjacent the inlet end, and so as to permit pivotal movement of the frame and housing about a first pivotal axis 23. This pivotal mounting arrangement permits the assembly 10 to be pivotally moved between a generally horizontal position as seen in FIG. 1, and an upwardly inclined position as seen in FIG. 6, and while the wheeled carriage 22 remains in ground engaging contact.

The frame 13 of the conveying assembly 10 also includes a fifth wheel 24 at the material outlet end for permitting the apparatus to be coupled to a highway tractor. When coupled to a tractor, the assembly 10 is highway transportable. The assembly also includes a conventional jack 25 for supporting the frame in a generally horizontal position when the tractor is removed.

Figure 3:
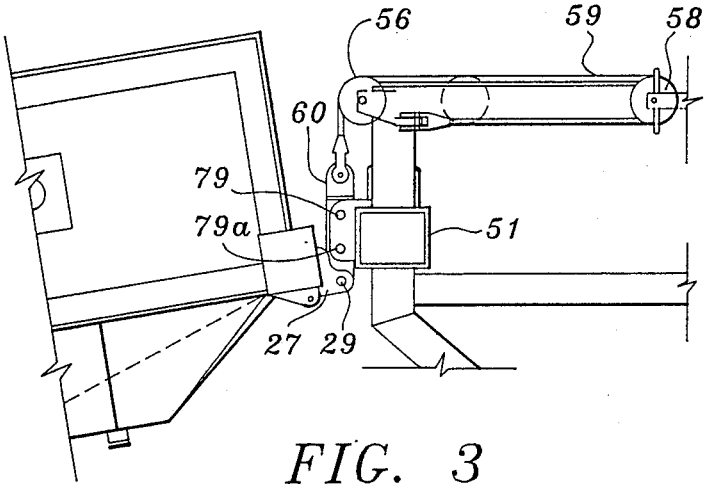
FIG. 3 is an enlarged fragmentary view of the two interconnected ends of the assemblies in the position of FIG. 2.
Figure 4:
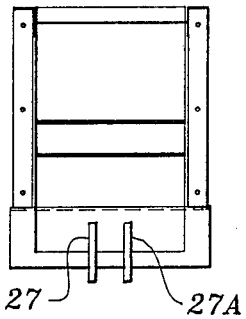
FIG. 4 is a front elevation view of the forward end of the material conveying assembly.

As best seen in FIGS. 3 and 4, a pair of laterally spaced apart plate-like lugs 27, **27*a* are mounted to the forward end of the conveying assembly, for the purposes described below. These lugs each include an opening, and the two openings are laterally aligned to receive a mounting pin 29**.

The material storage assembly 12 of the illustrated embodiment comprises a main frame composed of two laterally spaced apart I-beams 32, **32*a* (FIG. 8) which extend along the majority of its length. The left or forward end of the frame as seen in FIGS. 1 and 6 mounts an extension 33 which is positioned somewhat above the level of the I-beams, and which in turn mounts a fifth wheel 34 and supporting jack 35. The opposite or rear end of the main frame mounts a wheeled carriage 36 by an arrangement which permits the carriage to be selectively moved vertically between a lowered ground engaging position (not shown) and which permits highway transport of the apparatus, and a raised position wherein the main frame contacts the ground and as seen in FIG. 1 and 6**. A suitable mounting arrangement of this type is disclosed in copending and commonly owned application Ser. No. 07/296,491 filed Jan. 12, 1989.

The main frame of the assembly 12 rigidly mounts a pair of vertical support braces 38, which extend upwardly from respective ones of the I-beams 32, **32*a*, and an inclined support brace 39 extending between the upper end of each of the support braces and the associated I-beam. Further, a control housing 40** is mounted on the main frame above the wheeled carriage, which houses the various control panels associated with the apparatus.

The main frame of the assembly 12 also mounts a secondary frame which includes a forward end portion 43 and an opposite rear end portion 44. The secondary frame in turn encloses and supports a mix storage container 46. The container is of conventional design, and includes an open top, lower discharge gate 47, and insulated side walls. Also, a conventional weigh batcher 48 is disposed below the discharge gate, and a conventional batcher 49 is mounted at the forward end portion and above the top of the container 46. The batcher 49 is for the purpose of receiving and collecting the granular material from the elevator and dropping the material in batches into the container rather than in a continuous stream, to thereby reduce the tendency of the material to segregate by size.

Figure 9:
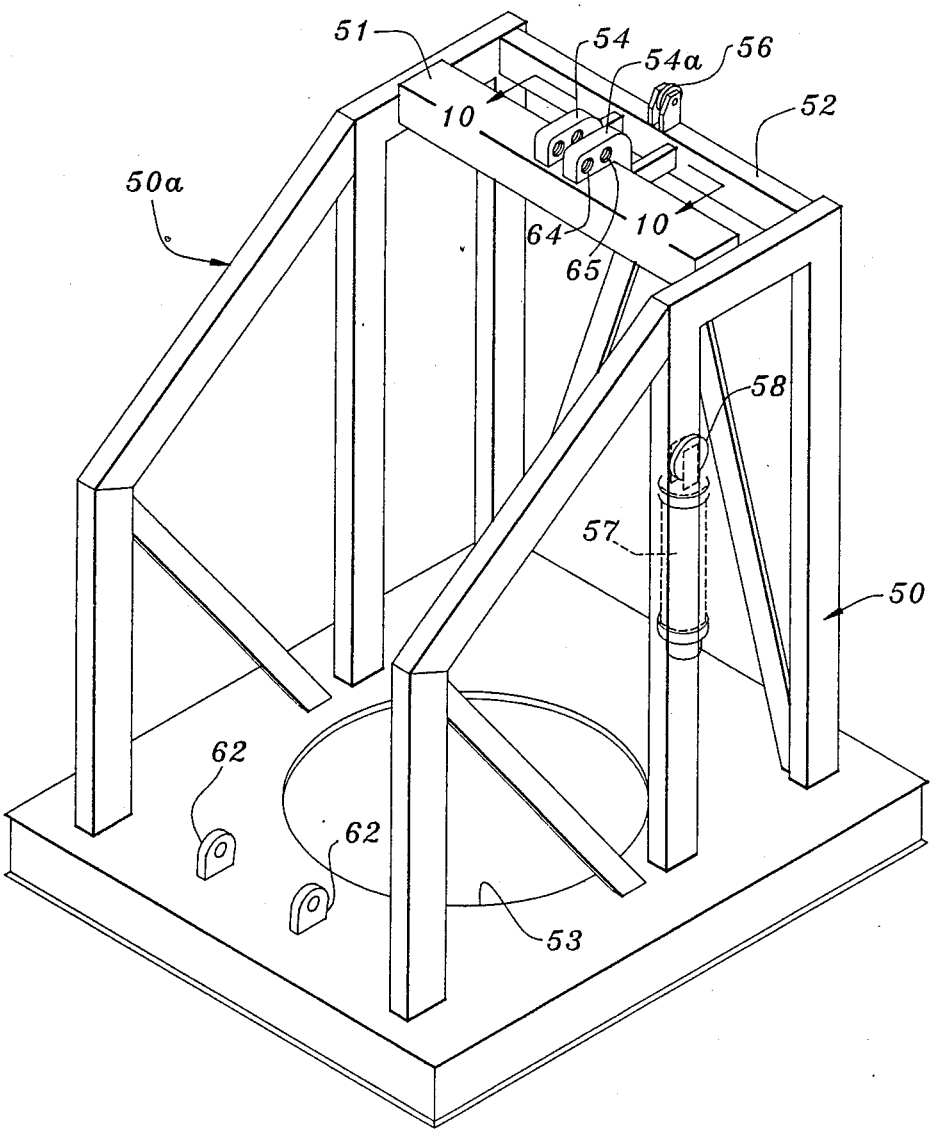
FIG. 9 is a perspective view of the framework at the forward or upper end of the material storage assembly.

The forward end portion 43 of the secondary frame is best seen in FIG. 9, with the batcher 49 being omitted for clarity of illustration. The forward end portion 43 comprises a framework which includes a pair of like side frames 50, **50*a*, and a pair of upper cross-beams 51, 52 extending laterally between the side frames. A pair of plate-like lugs 54, 54*a* are attached to the midpoint of the cross-beam 51, and a pulley 56 is attached to the beam 52 in alignment with the pair of lugs 54, 54*a*. Also, a hydraulic cylinder 57 is attached to the base of the framework, and the output shaft of the cylinder mounts a pulley 58. A cable 59 (FIG. 3) is also provided which has one end attached to the cross-beam 52, and a second free end which mounts a pivot bar 60. The intermediate portion of the cable is entrained about the pulleys 56 and 58. The forward end portion of the secondary frame also includes an opening 53 which is positioned below the batcher 49 for admitting the material into the container, and a pair of mounting lugs 62** for the purpose set forth below.

Figure 12:
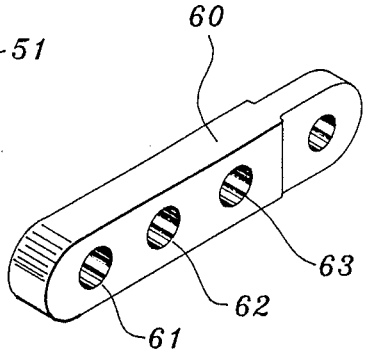
FIG. 12 is a perspective view of the pivot bar of the present invention.

The pivot bar 60 is sized to be received between the lugs 27, **27*a* on the conveying assembly, and also between the lugs 54, 54*a* on the storage assembly. Also, the bar 60 includes three openings 61, 62, 63 as best seen in FIG. 12, and each of the lugs 54, 54*a* includes two openings 64, 65 which are positioned to be aligned with the rear two openings 62, 63 in the pivot bar when the bar is received between the lugs 54, 54*a***.

The rear end portion 44 of the secondary frame is pivotally mounted to the main frame, which permits pivotal movement of the secondary frame with respect to the main frame about a second horizontal axis 66 which extends between posts of the upper ends of the vertical support braces 38, and adjacent the joint between each vertical brace 38 and its associated inclined brace 39. Thus the second pivotal axis 66 is elevated so as to lie substantially in horizontal alignment with the upper portions of the secondary frame and the container in the horizontal position thereof, and so that the container is elevated in the upright position a distance sufficient to receive a truck T therebelow, note FIG. 6.

The secondary frame 42 also includes a supporting framework 68, which is pivotally mounted for movement about an axis 69 which is parallel to the second axis 66. The axis 69 is located adjacent the weigh batcher 48 and on the side thereof opposite the second axis 66. The supporting framework 68 comprises a pair of support legs 70, two cross braces 71, and inclined transverse braces 72. The entire framework is initially supported adjacent the weigh batcher, and it is designed to be lowered by a winch (not shown) to a vertical position when the apparatus is erected. The lower ends of the two support legs 70 are then pinned to the main frame at 73, so that the legs then support a portion of the weight of the secondary frame and container.

The storage assembly 12 further comprises lifting means mounted between the main frame and the secondary frame for pivoting the secondary frame and the container between the horizontal position (FIG. 1) and the upright position (FIG. 6). In the illustrated embodiment, this lifting means comprises a pair of lifting hydraulic jacks 74, with the two jacks being aligned on opposite sides of the assembly. More particularly, each jack is pivotally attached to one of the I-beams at 75, and is pivotally attached to the secondary frame at 76.

Description of the Method of Erection

To effect erection of the apparatus at the construction site, the conveying assembly 10 and the storage assembly 12 are initially connected to highway tractors and transported to the site. In this regard, it will be understood that the wheeled carriage 36 of the storage assembly will be lowered with respect to the main frame, so as to support the main frame above the ground level and permit the assembly to be transported. Once at the site, the two assemblies are longitudinally aligned in a nose-to-nose arrangement wherein the outlet end 17 of the conveying assembly 10 is opposed to the forward end portion 43 of the secondary frame of the storage assembly 12. The wheeled carriage 36 of the storage apparatus is then lifted upwardly with respect to the main frame, by any suitable lifting mechanism. The main frame thus drops onto the ground to the position as shown in FIG. 1, and it thereafter serves as a foundation pad for the entire apparatus. As an alternative, the wheeled carriage 36 may be fixed to the main frame in a lowered ground engaging position, and the main frame may then be lowered by moving the assembly 12 so that the wheeled carriage drops into a trench formed in the ground.

Figure 2:
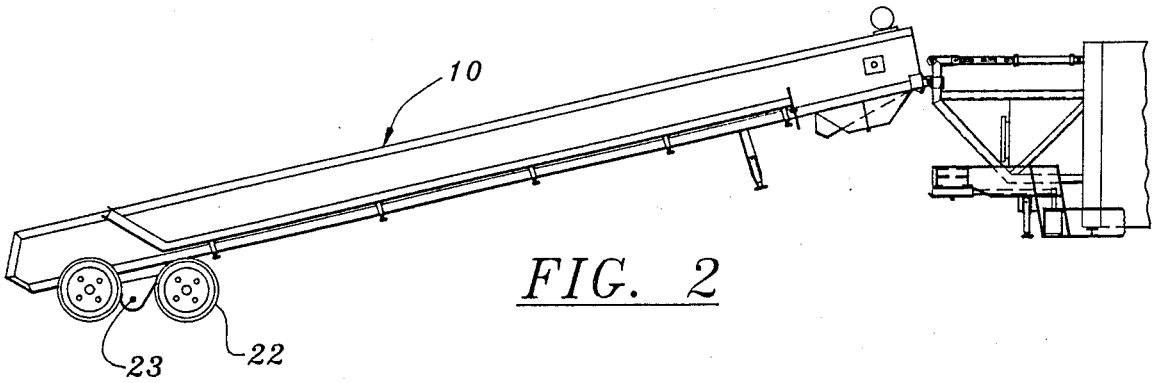
FIG. 2 illustrates the two assemblies at an intermediate position during the erection process.

The hoisting cable 59 is then extended by the hydraulic cylinder 57, and so as to permit the pivot bar 60 to be pivotally connected by the pin 29 to the first pair of lugs 27, **27*a*. The cylinder 57 is then retracted to draw the pair of lugs 27, 27*a* and thus the forward end 17 of the conveying assembly 10 upwardly toward the second pair of lugs 54, 54*a*. This results in the entire conveying assembly 10 moving across the ground on the wheeled carriage 22 toward the storage assembly, while pivoting about the first axis 23. The two assemblies thus are brought to the position shown in FIGS. 2 and 3, and such that the pivot bar 60 self-aligns between the pair of lugs 54, 54*a* on the storage assembly. The bar may then be pinned to the pair of lugs 54, 54*a* by two additional pins 79, 79*a*, which pass through the openings 62, 63 in the pivot bar, and the openings 64, 65 in each of the lugs 54, 54*a***. This results in a fixed interconnection between the bar and the second pair of lugs.

Figure 5:
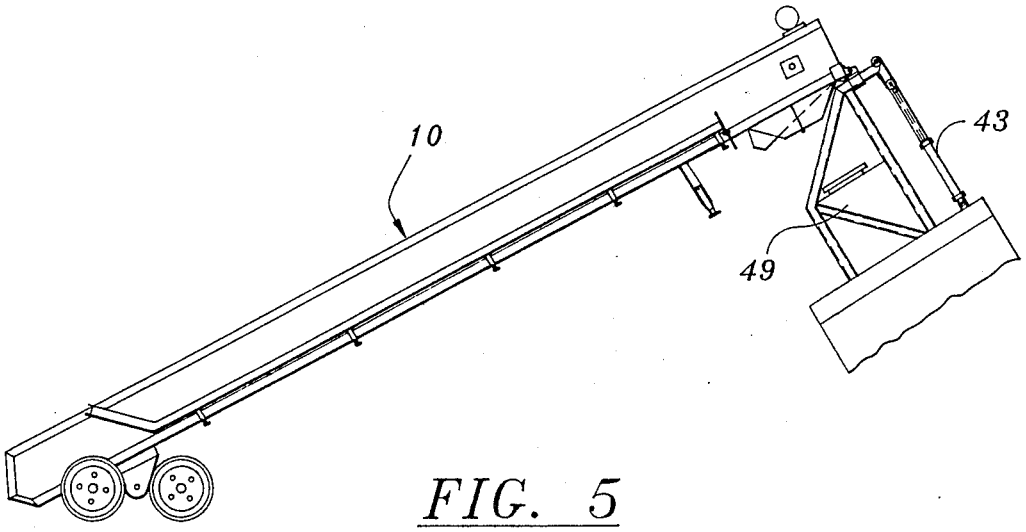
FIG. 5 is a view similar to FIG. 2 and showing the two assemblies in a subsequent position during the erection process.
Figure 10:
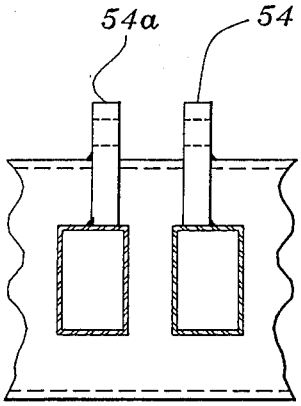
FIG. 10 is an enlarged fragmentary and sectional view of the mounting lugs and taken substantially along the line 10—10 of FIG. 9.
Figure 11:
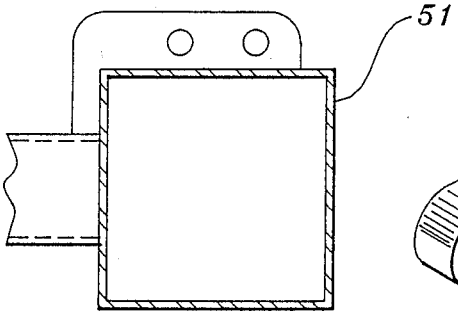
FIG. 11 is a sectional view taken at right angles to FIG. 10.

The two hydraulic jacks 74 are then extended which causes the secondary frame of the storage assembly 12 to pivot about the elevated second axis 66. This pivotal lifting in turn causes the material conveying assembly 10 to pivot about the first axis 23 while moving across the ground toward the storage assembly on the wheeled carriage 22. The two assemblies also pivot relative to each other about a horizontal third axis defined by the pin 29. The assemblies thus move in one continuous smooth operation through the intermediate position shown in FIG. 5, and to the final or elevated position as shown in FIG. 6.

Upon completion of the erection operation, the supporting framework 68 is lowered by a winch from its storage position so as to extend vertically between the secondary frame and the main frame. The two support legs 70 of the supporting framework are then pinned to the main frame at 73 so as to partially support the weight of the secondary frame and the container. Thus the pair of vertical braces 38 and the two support legs 70 define an open space therebetween, note FIG. 6.

It will also be seen that the elevated location of the second axis 66 results in the secondary frame and the container being elevated a distance sufficient to permit a dump truck T to be driven therebelow. In this regard, the area between the I-beams 32, **32*a* of the main frame below the erected container may be filled with gravel or the like to permit the truck to be driven through the opening defined between the vertical braces and the support legs and as shown in FIG. 6**.

Figure 8:
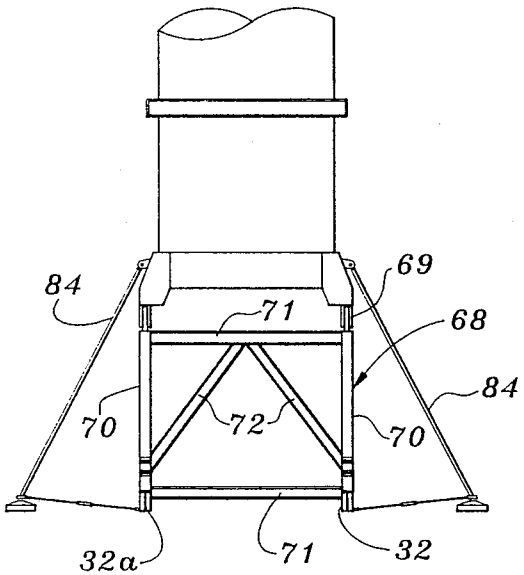
FIG. 8 is a fragmentary front elevation view of the lower portion of the material storage assembly and illustrating the reinforcing outriggers.

To complete the erection process, a pair of turnbuckles 81 are connected between the conveying assembly and the lugs 62 on the frame, and a second pair of turnbuckles 82 are connected between the supporting frame 13 adjacent the wheeled carriage 22 and the forward end of the main frame. Also, a pair of outriggers 84 are extended laterally as seen in FIG. 8 to provide improved lateral support for the apparatus.

Upon completion of the necessary power connections, the conveying assembly 10 and the storage assembly 12 are then ready for operation. In use, the hot asphaltic mix is delivered by a truck from a production plant, and is discharged into the material inlet end 16 of the conveying assembly 10. The conveying assembly lifts the hot mix and discharges it through the chute 18 to the insulated storage container. When desired, a predetermined amount of the hot mix is discharged into the weigh batcher 48 and then discharged into an awaiting truck T.

In the drawings and specification, there has been set forth a preferred embodiment of the invention, and although specific terms are employed, they are used in a generic and descriptive sense only and not for purposes of limitation.

That which is claimed is:

1. A portable self-erecting storage apparatus for temporarily storing and dispensing asphaltic mix and the like and comprising:

a material conveying assembly comprising a supporting frame, an elongate material conveyor mounted to said frame and defining a material inlet and a material outlet end, wheeled ground engaging carriage means pivotally mounted to said frame adjacent said inlet end of said conveyor for permitting highway transport of said material conveying assembly and for permitting pivotal movement of said frame and said conveyor about a horizontal transverse first pivotal axis and such that said conveyor may be pivotally moved between an initial generally horizontal position and an upwardly inclined position wherein said outlet end is elevated, a material storage assembly comprising an elongate main frame, wheeled ground engaging carriage means mounted to said main frame for permitting highway transport of said material storage assembly, a secondary frame including a forward end portion and an opposite rear end portion, with said rear end portion being pivotally mounted to said main frame for pivotal movement about a horizontal second pivotal axis, and a storage container mounted to said secondary frame and positioned between said forward and rear opposite end portions, and such that said secondary frame and said container may be pivoted about said second pivotal axis between an initial generally horizontal position and a vertical upright position, and lifting means mounted between said main frame and said secondary frame for pivoting said secondary frame and said container between said initial position and said upright position, and interconnecting means for releasably and pivotally interconnecting said forward end portion of said secondary frame of said material storage assembly with said supporting frame of said material conveying assembly at a location adjacent said outlet end of said conveyor and while said material conveying assembly and said material storage assembly are each in their respective initial positions, and so as to permit relative pivotal movement about a horizontal third pivotal axis, whereby the conveying assembly and the storage assembly may be longitudinally aligned with the outlet end of said conveyor being opposed to said forward end portion of said secondary frame, then interconnected by said interconnecting means for relative pivotal movement about said third pivotal axis, and with said first, second, and third pivotal axes being parallel to each other, and then collectively lifted by said lifting means to an operative position wherein said container is upright and said outlet end of said conveyor is elevated and disposed above said container.

2. The portable self-erecting storage apparatus as defined in claim 1 wherein said second pivotal axis is elevated so as to lie substantially in horizontal alignment with the upper portions of said secondary frame and said container in said initial position thereof, and so that said container is elevated in said upright position a distance sufficient to receive a truck therebelow.

3. The portable self-erecting storage apparatus as defined in claim 2 wherein said secondary frame includes a support leg pivotally mounted thereto and which is positioned to extend vertically between said secondary frame and said main frame when said secondary frame is in said upright position and so as to partially support the weight of said secondary frame and said container.

4. The portable self-erecting storage apparatus as defined in claim 3 wherein said container includes discharge gate means at the lower end thereof for selectively discharging material therein into an underlying truck when said container is in said upright position.

5. The portable self-erecting storage apparatus as defined in claim 1 wherein said interconnecting means comprises a hoisting cable having a pivot bar mounted to a free end of said cable, a hoisting cylinder mounted to said forward end portion of said secondary frame and operatively connected to the other end of said hoisting cable, first lug means mounted to said supporting frame adjacent said outlet end of said conveyor, pin means for pivotally interconnecting said pivot bar to said first lug means to define said third pivotal axis, second lug means mounted to said forward end portion of said secondary frame, and additional pin means for interconnecting said second lug means and said bar in a fixed relationship, and whereby said pivot bar may be initially pinned to said first lug means, and said first lug means and said material conveying assembly may be drawn toward said second lug means by said hoisting cylinder so as to permit said additional pin means to interconnect said pivot bar to said second lug means.

6. The portable self-erecting storage apparatus as defined in claim 5 wherein each of said first and second lug means comprises a pair of laterally spaced apart plates, and said pivot bar is dimensioned to be adapted to be received between said plates of each of said lug means.

7. The portable self-erecting storage apparatus as defined in claim 1 wherein said container includes weigh batch means for receiving a selected quantity of material, and discharge gate means for selectively discharging material from said weigh batch means into an underlying truck when said container is in said upright position.

8. A method of erecting a storage apparatus for temporarily storing and dispensing asphaltic mix and the like and comprising the steps of:

providing a material conveying assembly comprising a supporting frame, an elongate material conveyor mounted to said frame and defining a material inlet end and a material outlet end, and wheeled ground engaging carriage means pivotally mounted to said frame adjacent said inlet end of said conveyor for permitting highway transport of said material conveying assembly and for permitting pivotal movement of said frame and said conveyor about a horizontal transverse first pivotal axis and so that said frame and said conveyor may be pivoted between an initial generally horizontal position and an upwardly inclined position, providing a material storage assembly comprising an elongate main frame, a secondary frame including a forward end portion and an opposite rear end portion, with said rear end portion being pivotally mounted to said main frame for pivotal movement about a horizontal second pivotal axis, and a storage container mounted to said secondary frame and positioned between said forward and rear opposite end portions, and such that said secondary frame and said container may be pivoted about said second pivotal axis between an initial generally horizontal position and a vertical upright position, longitudinally aligning the conveying assembly and the storage assembly with the outlet end of said conveyor being opposed to said forward end portion of said secondary frame and with said conveying assembly and said storage assembly each being in their respective initial positions, while in such alignment, pivotally interconnecting said forward end portion of said secondary frame of said material storage assembly with said supporting frame of said material conveying assembly at a location adjacent said outlet end of said conveyor, and so as to permit relative pivotal movement about a horizontal third pivotal axis, and then collectively pivoting the material conveying assembly about said first pivotal axis and pivoting the secondary frame and storage container of said material storage assembly about the second pivotal axis so as to cause relative pivotal movement about said third pivotal axis and to lift the same to an operative position wherein said container is upright and said outlet end of said conveyor is elevated and disposed above said container.

9. The method as defined in claim 8 wherein the collectively pivoting step comprises moving the material conveying assembly longitudinally toward the material storage assembly and while holding the material storage assembly against longitudinal movement.

10. The method as defined in claim 9 wherein the collectively pivoting step further comprises applying a force to said secondary frame of said material storage assembly so as to pivot the same about said second pivotal axis, and whereby the material conveying assembly is pivoted about the first pivotal axis and the material conveying assembly and the secondary frame and storage container of said material storage assembly relatively pivot about said third pivotal axis by the pivotal movement of said secondary frame and storage container about said second pivotal axis.

11. A method as defined in claim 8 wherein the aligning step includes positioning the main frame of said material storage assembly so as to directly rest upon the ground surface, and maintaining such position of the main frame during the collectively pivoting step and so that the main frame serves as a foundation pad for the erected apparatus.

* * * * *